US010487570B1

(12) United States Patent
Eickhoff et al.

(10) Patent No.: US 10,487,570 B1
(45) Date of Patent: Nov. 26, 2019

(54) DOOR WITH INTERIOR PROTECTIVE COATING

(71) Applicant: Schlage Lock Company LLC, Carmel, IN (US)

(72) Inventors: Brian C. Eickhoff, Danville, IN (US); Karen Bishop, Fairfield, OH (US); David J. Wells, Cincinnati, OH (US); Matthew A. Phillips, Greenfield, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 16/027,729

(22) Filed: Jul. 5, 2018

(51) Int. Cl.

| | |
|---|---|
| ***E06B 3/82*** | (2006.01) |
| ***E06B 3/70*** | (2006.01) |
| ***E06B 5/10*** | (2006.01) |
| ***E06B 5/20*** | (2006.01) |

(52) U.S. Cl.
CPC ..... *E06B 3/827* (2013.01); *E06B 3/7015* (2013.01); *E06B 5/10* (2013.01); *E06B 5/20* (2013.01); *E06B 2003/7051* (2013.01); *E06B 2003/7076* (2013.01)

(58) Field of Classification Search
CPC ..... E06B 3/827; E06B 5/20; E06B 3/7015; E06B 5/10; E06B 2003/7051; E06B 2003/7076
USPC ..... 52/784.1
See application file for complete search history.

(56) References Cited

U.S. PATENT DOCUMENTS

| | | | | |
|---|---|---|---|---|
| 3,256,573 | A * | 6/1966 | Hunter | B22C 5/0427 241/110 |
| 5,392,583 | A * | 2/1995 | Gregory | E04D 3/365 52/408 |
| 6,290,314 | B1 | 9/2001 | Kim | |
| 6,766,652 | B2 | 7/2004 | Kelly et al. | |
| 7,520,138 | B2 | 4/2009 | Kim et al. | |
| 7,520,139 | B2 | 4/2009 | Kim et al. | |
| 8,999,478 | B1 * | 4/2015 | Medlen | E06B 3/7001 428/99 |
| 9,151,084 | B2 | 10/2015 | Wachtell et al. | |
| 9,410,363 | B2 | 8/2016 | Knutson | |
| 9,719,289 | B2 | 8/2017 | Tavarez | |
| 2005/0173323 | A1 | 8/2005 | Meuleners et al. | |

(Continued)

FOREIGN PATENT DOCUMENTS

| | | |
|---|---|---|
| AU | 769414 B2 | 1/2004 |
| EP | 979918 A2 | 2/2000 |

(Continued)

*Primary Examiner* — Jeanette E Chapman
(74) *Attorney, Agent, or Firm* — Taft Stettinius & Hollister LLP

(57) ABSTRACT

An exemplary door has a hollow interior, and includes a first panel and a second panel that are secured to one another such that a gap is formed therebetween. Each panel has an interior side that faces the hollow interior and an exterior side that is exposed to view. The door further includes a protective coating system that is disposed on the interior side of at least one of the panels. The coating is formed of a two-part elastomeric composition, such as a two-part elastomeric polyurethane composition or a two-part elastomeric polyurea composition. The coating improves the thermal, acoustic, and/or ballistic performance characteristics of the door.

22 Claims, 2 Drawing Sheets

(56) References Cited

U.S. PATENT DOCUMENTS

| | | | | |
|---|---|---|---|---|
| 2006/0265979 | A1* | 11/2006 | Cording | A47F 3/0434 52/204.5 |
| 2009/0050629 | A1* | 2/2009 | Ohnstad | B60K 15/03177 220/560.02 |
| 2011/0117285 | A1* | 5/2011 | Morrison | B05D 1/06 427/470 |
| 2015/0368036 | A1* | 12/2015 | Bromley | B65D 90/02 414/299 |
| 2016/0145935 | A1 | 5/2016 | Bertovic | |
| 2018/0266172 | A1* | 9/2018 | Wray | E06B 7/20 |

FOREIGN PATENT DOCUMENTS

| | | | |
|---|---|---|---|
| EP | 1369549 | A1 | 12/2003 |
| EP | 2447458 | A2 | 5/2012 |
| WO | 2000075580 | A2 | 12/2000 |

* cited by examiner

DOOR WITH INTERIOR PROTECTIVE COATING

TECHNICAL FIELD

The present disclosure generally relates to hollow doors, and more particularly but not exclusively relates to hollow metal doors.

BACKGROUND

Hollow metal doors are among the most widely-used types of doors, and find use in virtually all environments in which doors are utilized. In addition to providing a physical access barrier between two areas, it is often desirable for such doors to act as a barrier to the passage of sound, the transmission of heat, and/or the travel of ballistics. Currently-available hollow metal doors have various constructions for providing desired acoustic, thermal, and ballistic performance characteristics. In certain doors, these constructions are provided in the hollow interiors of the door. For example, the hollow interiors of such doors may have mounted therein pads that absorb vibrations to reduce the transmission of sound or metal reinforcements that brace the panels against the impact of ballistics (e.g., windborne debris in severe weather conditions), or the hollow interiors may be filled with an insulating material that reduces the transmission of heat. In other doors, the constructs intended to provide the door with the desired characteristics are mounted to the exposed exterior of the door. However, each of these approaches has certain drawbacks or limitations, such that there remains a need for further improvements in this technological field.

SUMMARY

An exemplary door has a hollow interior, and includes a first panel and a second panel that are secured to one another such that a gap is formed therebetween. Each panel has an interior side that faces the hollow interior and an exterior side that is exposed to view. The door further includes a protective coating system that is disposed on the interior side of at least one of the panels. The coating is formed of a two-part elastomeric composition, such as a two-part elastomeric polyurethane composition or a two-part elastomeric polyurea composition. The coating improves the thermal, acoustic, and/or ballistic performance characteristics of the door. Further embodiments, forms, features, and aspects of the present application shall become apparent from the description and figures provided herewith.

DETAILED DESCRIPTION OF ILLUSTRATIVE EMBODIMENTS

Figure 1:
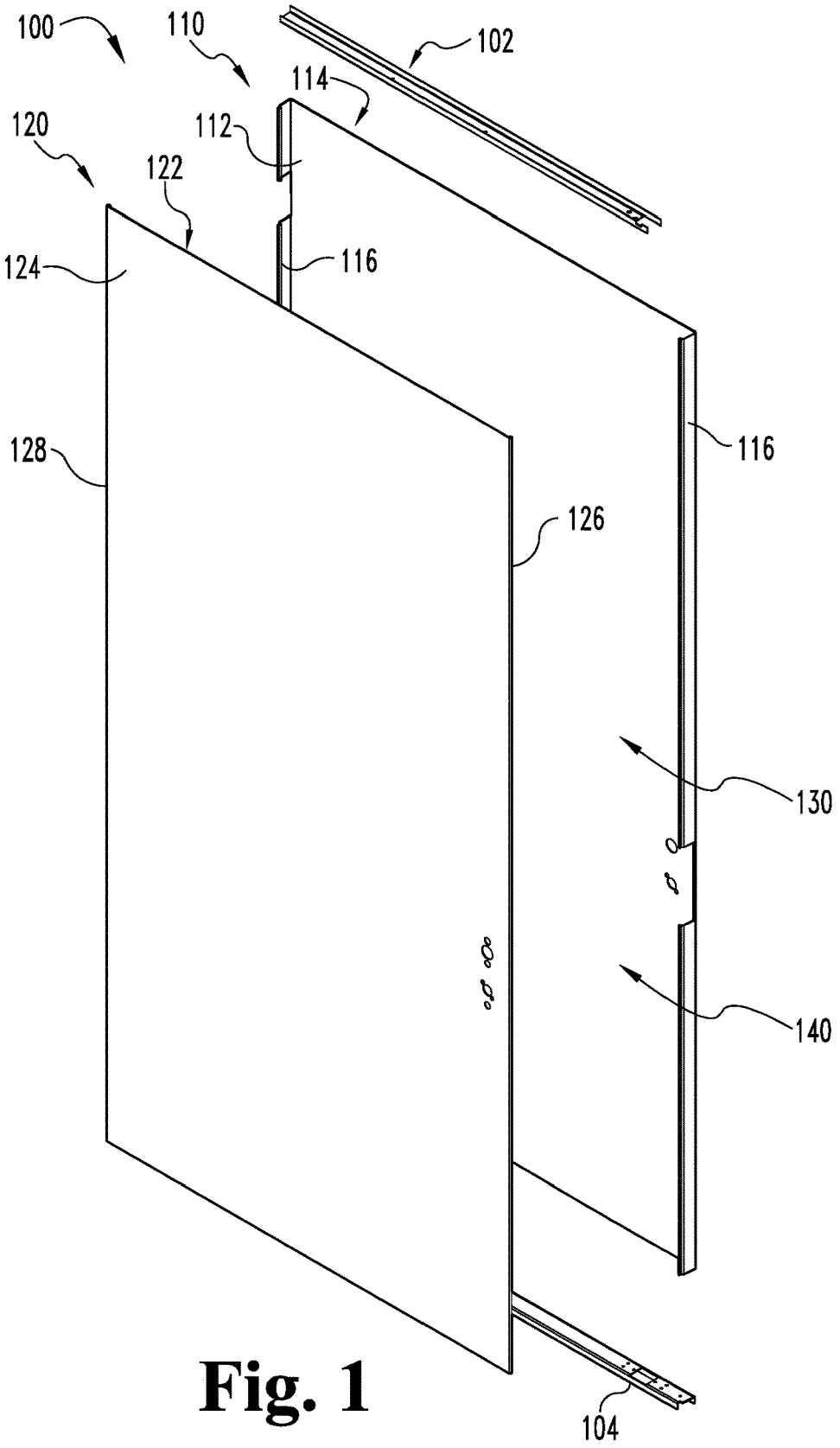
FIG. 1 is an exploded assembly view of a door according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C), as can items listed in the form of "A, B, and/or C". Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a door 100 according to certain embodiments. The door 100 generally includes a first panel 110 and a second panel 120. Each panel 110, 120 has an interior surface that faces the other panel 110, 120, and an opposite exterior surface. For example, the first panel 110 has a first interior surface 112 and a first exterior surface 114, and the second panel 120 has a second interior surface 122 and a second exterior surface 124. The first panel 110 further includes a pair of flanges 116 that extend beyond the first interior surface 112, and the second panel 120 includes a shorter pair of flanges 126 that extend beyond the second interior surface 122. With the door 100 assembled, the flanges 116, 126 are engaged with one another and secure the panels 110, 120 together such that the door 100 has a hollow interior 130. The door 100 may further include a top runner 102 and a bottom runner 104 that cooperate with the panels 110, 120 to enclose the hollow interior 130.

Figure 2:
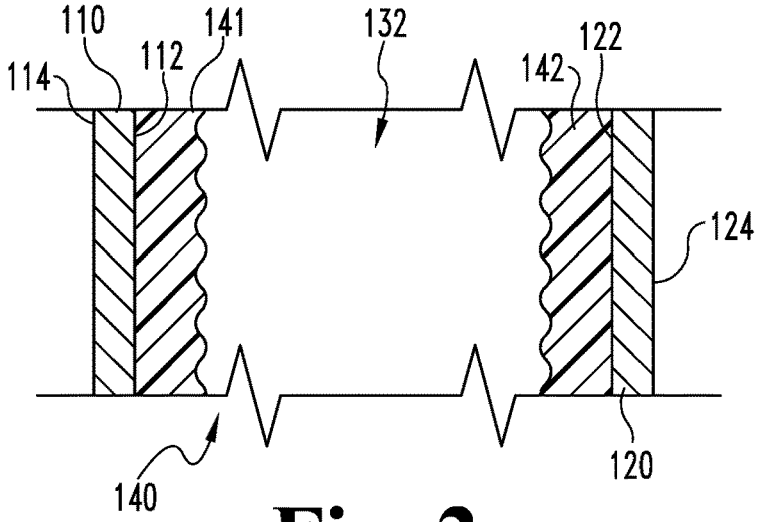
FIG. 2 is a cross-sectional illustration of the door illustrated in FIG. 1.
Figure 3:
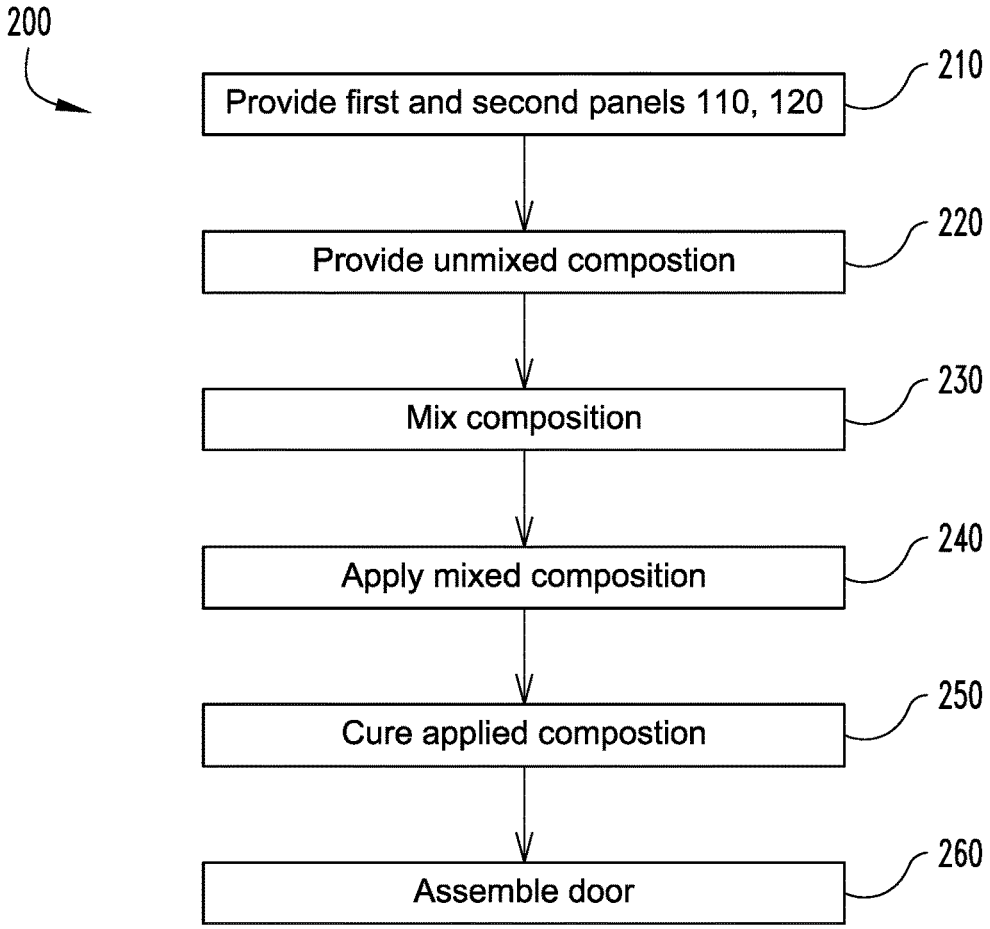
FIG. 3 is a schematic flow diagram of a process according to certain embodiments.

With additional reference to FIG. 2, the door 100 further includes a protective coating system 140 that improves the thermal, acoustic, and ballistic performance properties of the door 100. More particularly, the protective coating system 140 includes a first lining or coating 141 formed on the first interior surface 112 and a second lining or coating 142 formed on the second interior surface 122 such that a gap 132 is formed between the coatings 141, 142. In certain forms, the hollow interior 130 is free of infill material such that the gap 132 is an air gap. As described herein, each coating 141, 142 is formed of a two-part elastomeric composition 149 that has been mixed, applied to the interior surfaces 112, 122, and allowed to cure. In certain forms, the composition 149 may be a two-part elastomeric polyurethane composition. In other embodiments, the composition 149 may be a two-part elastomeric polyurea composition. Such compositions may, for example, be of a type commercially available from Rhino Linings® of San Diego, Calif., or LINE-X® of Huntsville, Ala.

With additional reference to FIG. 2, illustrated therein is a schematic flow diagram of a process 200 according to certain embodiments. The process 200 may begin with an operation 210, which involves providing the first panel 110 and the second panel 120. The operation 210 may involve manufacturing the panels 110, 120 from appropriate materials (e.g., sheet metal of a selected thickness), or may involve procuring the panels 110, 120 from a supplier. In certain forms, the operation 210 may involve increasing a surface roughness of the interior side surface 112, 122 to which the composition will be applied, thereby promoting adhesion.

The process 200 also includes an operation 220, which involves providing an unmixed two-part polymeric composition having a first part and a second part. The operation 220 may, for example, involve procuring a commercially-available form of the two-part composition from a supplier of the same, such as the suppliers mentioned above. After procuring the unmixed solution, the process 200 may continue to an operation 230, which involves mixing the first part of the two-part composition with the second part of the two-part composition, thereby producing a mixed composition.

The process 200 may then proceed to an operation 240, which involves applying the mixed composition to the interior side surface of at least one of the panels 110, 120 (i.e., the first interior surface 112 and/or the second interior surface 122). In the illustrated form, the operation 240 involves applying the mixed composition to each of the interior surfaces 112, 122. In certain forms, the operation 240 may involve applying the mixed composition to each of the interior surfaces 112, 122 without applying the mixed composition to the exterior surfaces 114, 124. When applied to the panels 110, 120, each applied layer has an apply thickness.

The process 200 also includes an operation 250, which generally involves curing the applied composition, thereby forming the hardened coatings 141, 142. Depending upon the nature of the composition, the operation 250 may, for example, involve exposing the applied composition to heat and/or light, or may simply involve allowing the applied composition to air-dry. In embodiments in which the operation 240 involves applying the mixed composition to each of the interior surfaces 112, 122, the operation 250 results in the protective coating system 140 having a first coating 141 disposed on the interior surface 112 of the first panel 110 and a second coating 142 disposed on the interior surface 122 of the second panel 120. When cured, each coating 141, 142 has a cured thickness. The composition may be configured to cure substantially without expanding such that the cured thickness of each coating 141, 142 is substantially the same as the apply thickness of the corresponding layer.

The process 200 further includes an operation 260, which generally involves assembling the door 100. More particularly, the operation 260 involves securing the first panel 110 to the second panel 120 such that the interior surfaces 112, 122 face one another and the exterior surfaces 114, 124 face outward. The operation 260 may further include securing each of the runners 102, 104 to each of the panels 110, 120 in the appropriate locations, thereby further enclosing the hollow interior 130. In certain forms, the assembling operation 260 may take place subsequent to the applying operation 240 and either prior to or during the curing operation 250. In other embodiments, the assembling operation 260 may take place after the completion of the curing operation 260.

With the operation 260 complete, the interior surfaces 112, 122 are concealed within the door 100, and the exterior surfaces 114, 124 are exposed to view. In embodiments in which the mixed composition is applied only to the interior surfaces 112, 122, the protective coating system 140 is entirely concealed within the door 100 such that no part of the protective coating system 140 is exposed to view. As a result, the application of the protective coating system 140 need not interfere with the overall aesthetic of the door 100.

As noted above, the protective coating system 140 aids in improving the thermal, acoustic, and ballistic performance properties of the door 100. For example, the protective coating system 140 acts as a thermal barrier that impedes the transmission of heat between the panels 110, 120, thereby reducing heat transmission through the door 100. Additionally, the protective coating system 140 absorbs or dampens vibration of the panels 110, 120, thereby reducing transmission of sound through the door 100 and improving the sound transmission control (STC) rating of the door. Furthermore, the protective coating system 140 is rigid enough to provide further structural support to the panels 110, 120, which improves the performance of the door 100 under severe weather conditions (e.g., tornado or hurricane conditions), in which the door 100 may be impacted by windborne debris.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A door, comprising:

a protective coating system comprising an elastomeric material, the protective coating system comprising a first protective coating and a second protective coating;

a first metal panel having a first exterior side and a first interior side opposite the first exterior side, wherein the elastomeric material is applied to the first interior side and forms the first protective coating thereon, and wherein the elastomeric material is not applied to the first exterior side; and a second metal panel arranged substantially parallel to the first metal panel, the second metal panel having a second exterior side and a second interior side opposite the second exterior side, wherein the elastomeric material is applied to the second interior side and forms the second protective coating thereon, and wherein the elastomeric material is not applied to the second exterior side;

wherein the second panel is coupled to the first panel such that the first interior side faces the second interior side; and wherein the first protective coating faces the second protective coating and a gap is formed therebetween.

2. The door of claim 1, wherein the elastomeric material is formed of a two-part elastomeric composition.

3. The door of claim 1, wherein the elastomeric material is one of an elastomeric polyurethane material or an elastomeric polyurea material.

4. The door of claim 1, wherein the gap is free of infill material.

5. The door of claim 1, wherein the protective coating system is contained entirely within the door.

6. The door of claim 1, wherein the first protective coating covers the entire first interior side, and wherein the second protective coating covers the entire second interior side.

7. The door of claim 1, wherein the protective coating system is structured to reduce transmission of sound through the door, to reduce transmission of heat through the door, and to increase a structural strength of the door.

8. A door, comprising:

a first panel having a first exterior side and a first interior side opposite the first exterior side;

a second panel having a second exterior side and a second interior side opposite the second exterior side, wherein the second panel is coupled to the first panel, wherein the first exterior side and the second exterior side are exposed, wherein the first interior side faces the second interior side such that the first interior side and the second interior side are concealed within the door, and wherein a gap is formed between the first interior side and the second interior side such that the door has a hollow interior; and a protective coating system disposed on at least one of the first interior side and the second interior side, wherein the protective coating system comprises at least one protective coating formed of a cured two-part elastomeric composition, wherein the cured two-part elastomeric composition is disposed on neither the first exterior side nor the second exterior side, and wherein the protective coating system is positioned in the hollow interior of the door such that the protective coating system is concealed within the door.

9. The door of claim 8, wherein the hollow interior of the door is free of infill material.

10. The door of claim 8, wherein the lining includes a first lining portion disposed on the first interior side and a second lining portion disposed on the second interior side, and wherein the gap is formed between the first lining portion and the second lining portion.

11. The door of claim 8, wherein the lining coats substantially all of the first interior side and substantially all of the second interior side.

12. The door of claim 8, wherein the lining is disposed entirely within the hollow interior of the door such that no portion of the lining is exposed to view.

13. The door of claim 8, wherein each of the first panel and the second panel is formed of a metal.

14. The door of claim 8, wherein each of the first panel and the second panel is formed of a metal.

15. The door of claim 14, wherein the first panel and the second panel are arranged in parallel to one another.

16. A door, comprising:

a first door panel and a second door panel arranged substantially parallel to one another, wherein each of the first door panel and the second door panel has an interior side surface and an opposite exterior side surface; and a two-part elastomeric composition having a first part and a second part that are intermixed with one another to provide a mixed elastomeric composition;

wherein the mixed elastomeric composition is applied to the interior side surface of the first door panel and to the interior side surface of the second door panel;

wherein the mixed elastomeric composition is cured to form a cured elastomeric composition defining a first protective coating on the interior side surface of the first door panel, and a second protective coating on the interior side surface of the second door panel;

wherein the first door panel is secured to the second door panel such that the interior side surface of the first door panel and the interior side surface of the second door panel face one another; and wherein the first protective coating faces the second protective coating and a gap is defined therebetween.

17. The door of claim 16, wherein the elastomeric composition has an apply thickness when the elastomeric composition is applied to the interior side surface of the first door panel;

wherein the first protective coating has a cure thickness when the first protective coating is fully cured; and wherein the apply thickness is the same as the cure thickness.

18. The door of claim 17, wherein the first protective coating is a substantially non-expandable coating.

19. The door of claim 17, wherein the elastomeric composition has a second apply thickness when the elastomeric composition is applied to the interior side surface of the second door panel;

wherein the second protective coating has a second cure thickness when the second protective coating is fully cured; and wherein the second apply thickness is substantially the same as the second cure thickness.

20. The door of claim 16, wherein a surface of the first side surface of the at least one of the first door panel and the second door panel is roughened prior to application of the mixed elastomeric composition thereto.

21. The door of claim 16, wherein the two-part elastomeric composition is one of a two-part elastomeric polyurethane composition and a two-part elastomeric polyurea composition.

22. The door of claim 16, wherein each of the first door panel and the second door panel is formed of a metal.

* * * * *